United States Patent [19]

McMullen et al.

[11] 4,242,767

[45] Jan. 6, 1981

[54] PLAY PILLOWS

[76] Inventors: Susan L. McMullen; David W. McMullen, both of 309 W. 82nd St., New York, N.Y. 10024

[21] Appl. No.: 938,152

[22] Filed: Aug. 30, 1978

[51] Int. Cl.[3] ..... A47C 7/02; A63H 33/08

[52] U.S. Cl. ..... 5/465; 5/434; 5/474; 46/25; 46/30; 297/456

[58] Field of Search ..... 46/25, 26, 30, 31, 22; 5/434, 465, 474; 297/456, 455

[56] References Cited

U.S. PATENT DOCUMENTS

| | | | |
|---|---|---|---|
| 195,850 | 10/1877 | Shepherd . | |
| 1,447,288 | 3/1923 | Emmerich . | |
| 1,661,690 | 3/1928 | Buchman | 5/434 |
| 2,061,510 | 11/1936 | Drumpelman | 46/30 |
| 2,135,657 | 11/1938 | Church | 297/455 X |
| 2,234,072 | 3/1941 | Braff | 5/434 |
| 2,450,326 | 9/1948 | Berger et al. | 46/22 |
| 2,548,547 | 4/1951 | Melrose | 5/357 |
| 2,623,574 | 12/1952 | Damsch | 297/455 X |
| 2,659,421 | 11/1953 | Wass et al. | 5/474 |
| 3,112,956 | 12/1963 | Schick et al. | 297/455 X |
| 3,610,689 | 10/1971 | Smith | 297/456 |
| 3,808,616 | 5/1974 | White | 5/465 X |
| 3,911,512 | 10/1975 | Plate | 5/352 |

FOREIGN PATENT DOCUMENTS

| | | | |
|---|---|---|---|
| 485417 | 5/1938 | United Kingdom | 5/474 |

*Primary Examiner*—F. Barry Shay

*Attorney, Agent, or Firm*—Blum, Kaplan, Friedman, Silberman & Beran

[57] ABSTRACT

A play pillow construction comprised of a plurality of polygonal shaped pillows that are releasably securable to each other to define a plurality of polyhedral shapes is provided. Each pillow includes a cushion insert and a trim of belting material. Each edge of each pillow is of equal length and each pillow is provided with fasteners to permit the pillows to be connected to each other and define the various polyhedral shapes.

11 Claims, 7 Drawing Figures

PLAY PILLOWS

BACKGROUND OF THE INVENTION

This invention is directed to a play pillow construction that defines a plurality of polyhedral shapes and, in particular, to a play pillow construction having a plurality of polygonal pillows, each pillow having shape retension and allowing for fastening to another like configured pillow to form various geometric shapes. It is intended that polygonal shaped play pillows be used together as an educational and recreational toy that will teach a child the concepts of space and structure.

Heretofore, children have been provided with numerous toys that allow structures to be built. Such building toys have been found to be recreational and educational for school age children. It is noted, however, that toddlers and pre-school children often find such building toys to be difficult to assemble and lacking in play value. Toddlers and pre-schoolers prefer toys that are soft, cuddly and unbreakable. Accordingly, a building toy formed entirely of soft goods, such as fabric, foam rubber and the like that would permit a child to freely express his own creativity, form useful and decorative items that will give a child a feeling of accomplishment and satisfaction is desired.

SUMMARY OF THE INVENTION

Generally speaking, in accordance with the instant invention, a play pillow construction is provided. The pillow construction includes a plurality of polygonal shaped pillows including a cushioning material that is hemmed between two layers of fabric. Both layers of fabric extend beyond the cushioning material and define a peripheral portion surrounding the cushioning material. A belting material is disposed in the peripheral portion of the fabric to thereby surround the perimeter of the cushion, thus giving the pillow form with softness. The edges of each polygonal pillow are of equal length and fasteners are disposed on each side of each edge for enabling each of the pillows to be joined to each other to form a multitude of polyhedral shapes.

Accordingly, it is an object of the instant invention to provide a child with an educational play pillow toy construction that teaches the basic concepts of space and structure.

A further object of the instant invention is to provide a soft, washable and unbreakable play pillow construction building toy for pre-school and toddler age children.

Another object of the instant invention is to provide a play pillow construction that permits the building of inexpensive furniture items and other inexpensive decorative items.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 2:
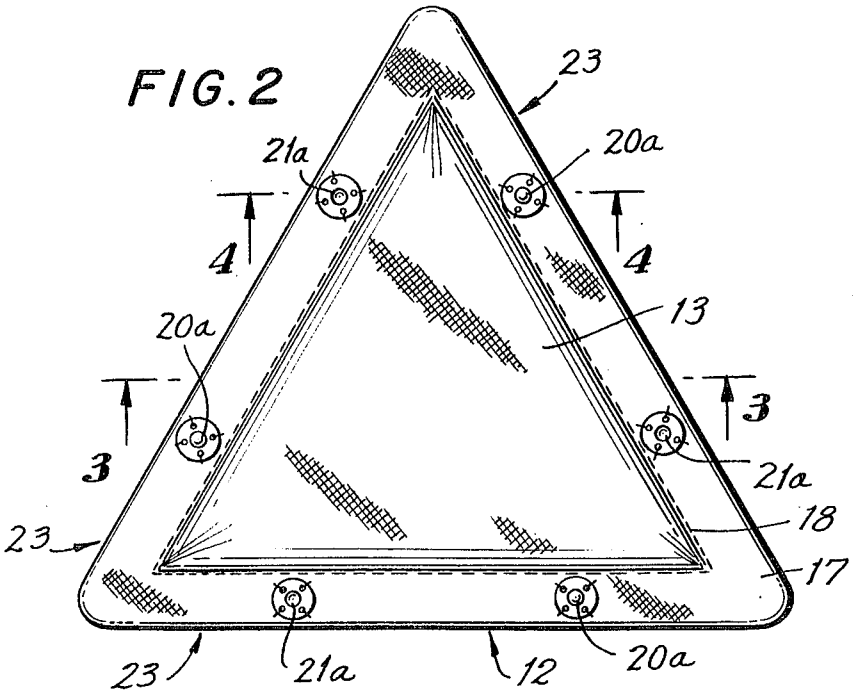
FIG. 2 is a plan view of a play pillow.
Figure 1:
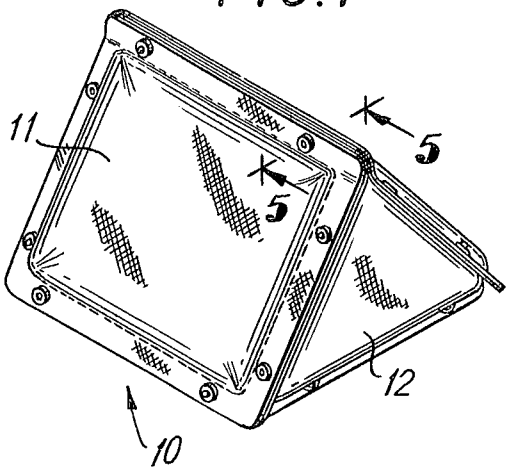
FIG. 1 is a perspective view of a play pillow construction constructed in accordance with a first embodiment of the instant invention.
Figure 3:
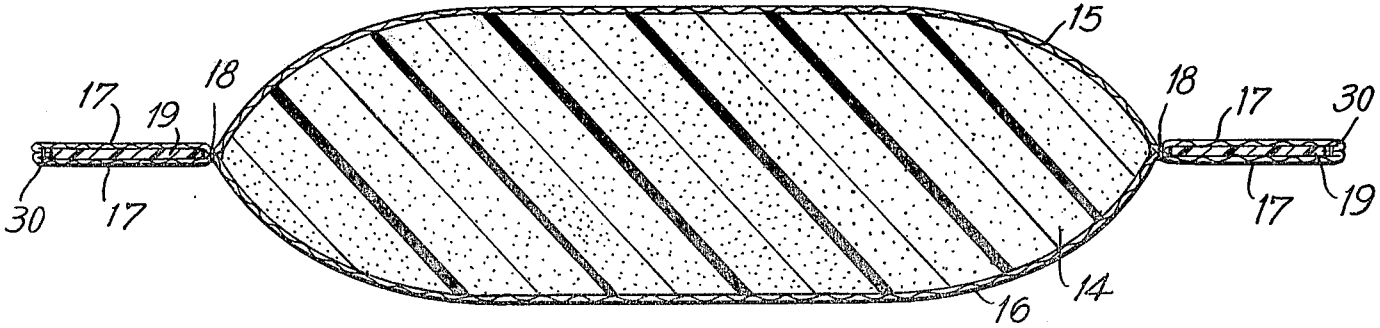
FIG. 3 is an enlarged sectional view taken along line 3—3 of FIG. 2.
Figure 5:
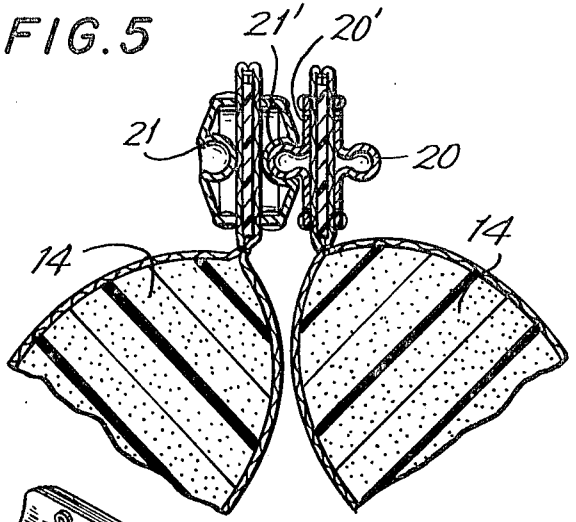
FIG. 5 is an enlarged sectional view taken along line 5—5 of FIG. 1.

Reference is first made to FIG. 1, wherein a play pillow construction, generally indicated as 10, is depicted. Play pillow construction 10 is comprised of a plurality of square shaped pillows 11 and equilateral triangular shaped pillows 12 joined to form a three dimensional triangular shape. As is detailed below, each of the three square pillows 11 and two triangular pillows 12 are releasably secured together by snap fasteners to form the polyhedral triangular shape depicted.

Referring now to FIGS. 2 through 5, the construction of triangular pillow 12 is depicted in detail. A cushioning material 14, such as foam rubber or the like, is shaped in the triangular form of the pillow and is covered by an upper layer of fabric 15 and a lower layer of fabric 16. The respective layers of fabric are folded under at their respective edges and sewn together, at 30, and are further hemmed at 18 about the cushioning material 14 to enclose same therein. A peripheral portion 17 of each fabric layer extends beyond the hem 18 to enable a continuous trim of suitable belting material 19 to be enclosed therein. The peripheral portion of fabric 17 and the continuous trim of belting material 19 enclosed therein provide the pillow with form.

Male snap fasteners **20*a* and 20*b* and female snap fasteners 21*a* and 21*b* are connected on both sides of each peripheral portion of each pillow. Each peripheral portion 23 of each polygonal pillow (triangular or square) is of equal length. Accordingly, male fasteners 20*a* and 20*b* and female fasteners 21*a* and 21*b* are connected to the peripheral portions of the pillows to enable the peripheral portions of the pillows to be releasably fastened to other similar peripheral portions of square pillows 11 and triangular pillows 12. The position of male fasteners 20*a* and 20*b* and, similarly, female fasteners 21*a* and 21*b*** on each side of the peripheral portion of each pillow are identical. By positioning the same male fasteners and female fasteners at the same position on both sides of the peripheral portion of the pillow, each of the pillows can be universally joined in a plurality of configurations to define distinct polyhedral shapes.

Figure 7:
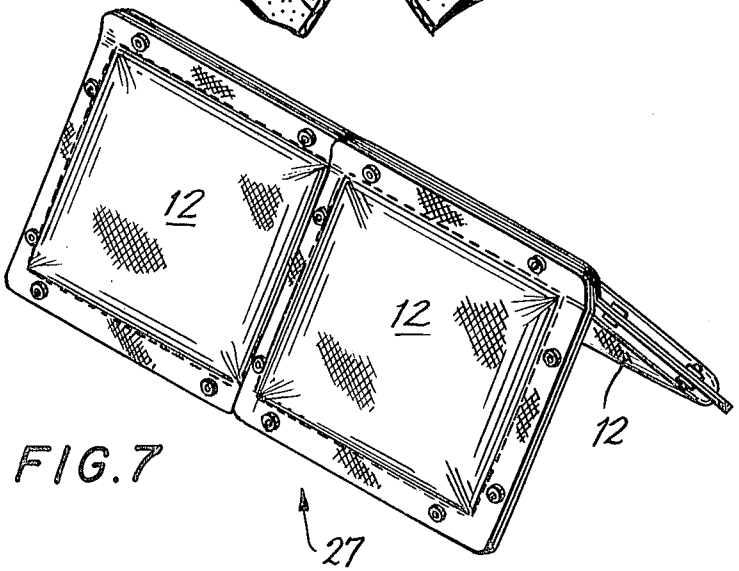
FIG. 7 is a perspective view of a play pillow construction constructed in accordance with a third embodiment of the instant invention.
Figure 4:
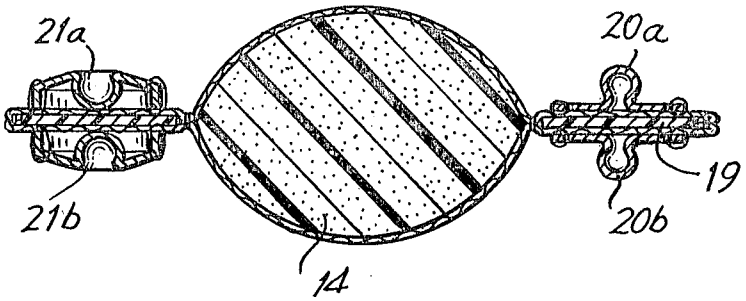
FIG. 4 is an enlarged sectional view taken along line 4—4 of FIG. 2.
Figure 6:
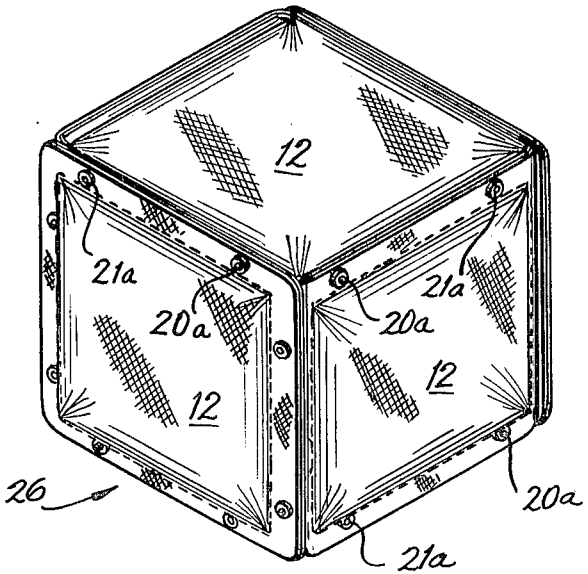
FIG. 6 is a perspective view of a play pillow construction constructed in accordance with a second embodiment of the instant invention.

Referring now to FIG. 6, a second embodiment wherein six square play pillows 12 are releasably connected to form a cube, generally indicated as 26, is depicted. Similarly, still a further embodiment of the instant invention utilizing a plurality of square pillows 12 to form a third polyhedral shape, generally indicated as 27, is depicted in FIG. 7.

It is noted that the instant invention is not limited to the polyhedral shapes, illustrated in the drawings and described above. Any number of fully enclosed polyhedral shapes and other shapes, such as geodesik dome or the like, can be constructed utilizing the play pillows of the instant invention. In an exemplary embodiment, the layers of fabric can be cotton, corduroy or any other durable yet washable fabric. Also, the layers can be formed in different colors to add play value. Furthermore, the respective layers can be secured together and formed of an air impervious material so that an inflatable cushion and a further inflatable stiffening trim is defined.

It is further noted that the edge dimensions of polygonal shaped pillows can be varied for different aged children. For example, polygonal shaped pillows having a 6" edge would be particularly suitable for children aged 4 to 8 years. Similarly, for children in the 8 to 12 year old age group, pillows having an edge in the range of 12" to 24" could be provided. Finally, by providing each of the pillows with a side edge of at least 2 feet in length, and by utilizing bright colored fabric in the pillow constructions, an attractive piece of furniture that can support a child or several light objects can be provided.

It is noted that the instant invention is not limited to utilizing the type of snap features noted above and, instead, can utilize any conventional washable and safe fastening mechanism such as Velcro, buttons and holes, etc., which allow the pillows to be freely connected to form various polyhedral shapes.

It will thus be seen that the objects set forth above, among those made apparent from the preceeding description, are efficiently attained and, since certain changes may be made in the above construction without departing from the spirit and scope of the invention, it is intended that all matter contained in the above description or shown in the accompanying drawings shall be intercepted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A play pillow construction comprising, in combination, a plurality of pillows, each pillow having multisided polygonal shaped cushioning means, first and second polygonal shaped layers of fabric, said respective layers of fabric being secured together to enclose said cushioning means therebetween and define a multisided polygonal peripheral portion entirely surrounding said cushioning means, a flexible shape retention means enclosed between the peripheral portions of said layers for stiffening the periphery of said pillow and a fastening means positioned on each peripheral portion side for enabling said pillow to be joined to another pillow of like configuration, said flexible shape retention means and said fastening means being cooperatively disposed on each peripheral portion side to thereby provide increased structural integrity to said peripheral portions, said plurality of pillows being joined to one another with their joined sides maintained in adjacent and parallel relationship to define a polyhedral configuration that has structural integrity provided by said flexible shape retention means utilized to stiffen the periphery of each of the pillows.

2. A play pillow comprising, in combination, a multisided polygonal shaped cushioning means, first and second polygonal shaped layers of fabric, said respective layers of fabric being secured together to enclose said cushioning means therebetween and define a multisided polygonal peripheral portion entirely surrounding said cushioning means, a flexible shape retention means enclosed between the peripheral portions of said layers for stiffening the periphery of said pillow, and a fastening means positioned on each peripheral portion side for enabling said pillow to be joined to another pillow of like configuration, wherein said fastening means positioned on each peripheral portion includes an operative fastening means disposed on both opposed surfaces of each peripheral portion side, each of said operative fastening means being disposed in a like position on both surfaces of each peripheral portion side.

3. A play pillow as claimed in claim 2, wherein each operative fastening means includes a male fastening means and female fastening means, said male fastening means on each opposed surface of each peripheral portion side being disposed at the same position, and each female fastening means on each opposed surface of each peripheral portion side being disposed at the same position.

4. A play pillow as claimed in claim 3, wherein each said male fastening means is a male snap fastener and each said female fastening means is a female snap fastener.

5. A play pillow as claimed in claim 2, wherein said shape retention means is a continuous band of belting material surrounding the said cushioning means.

6. A play pillow as claimed in claim 5, wherein said cushioning means is a polygonal foam rubber cushion.

7. A play pillow as claimed in claim 6, wherein said play pillow is formed in the shape of an equilateral triangle.

8. A play pillow as claimed in claim 6, wherein said play pillow is shaped in the form of a square.

9. A play pillow construction comprising a plurality of polygonal shaped pillows, each of said pillows being equilateral and each side of each pillow being of the same dimension, each of said pillows including a centrally positioned cushioning portion and a trim peripherally surrounding said cushioning portion and defining the sides of each pillow, said trim having first and second opposed surfaces, and fastening means disposed on each side of each pillow, each of said fastening means on each side of each pillow including at least one male fastening means positioned at substantially the same position on both opposed surfaces of each side of each pillow, and at least one female fastening means disposed at substantially the same position on both opposed surfaces of each side of each pillow so that each of said pillows can be universally coupled by said fastening means on each side to a fastening means on any side of each of the other pillows to thereby permit the pillows to form a plurality of polyhedral shapes.

10. A play pillow construction as claimed in claim 9, wherein said trim surrounding each cushion portion of each pillow is stiffer than said cushioning means.

11. A play pillow construction as claimed in claim 9, wherein said male fastening means are male snap fasteners and said female fastening means are female snap fasteners.

* * * * *